United States Patent [19]

von Holdt

[11] Patent Number: 4,653,669

[45] Date of Patent: Mar. 31, 1987

[54] MOLDED PLASTIC CONTAINER WITH INNER TUBULAR MEMBER

[76] Inventor: John W. Von Holdt, 7430 N. Croname Rd., Niles, Ill. 60648

[21] Appl. No.: 673,014

[22] Filed: Nov. 19, 1984

[51] Int. Cl.[4] ..... B67B 7/26; B67D 3/00; F23Q 7/00

[52] U.S. Cl. ..... 222/90; 222/525; 222/541; 222/537; 220/266; 220/85 SP

[58] Field of Search ..... 222/525, 541, 538, 81, 222/83, 89, 90, 522, 526, 537; 220/266, 270, 220/85 SP

[56] References Cited

U.S. PATENT DOCUMENTS

| | | | |
|---|---|---|---|
| 2,063,525 | 12/1936 | Schickel | 222/83 |
| 3,481,515 | 12/1969 | Booth et al. | 222/541 |
| 3,831,824 | 8/1974 | Coppersmith | 222/525 |
| 3,856,188 | 12/1974 | Newby | 222/541 X |
| 3,915,360 | 10/1975 | Leger et al. | 222/541 X |
| 4,513,883 | 4/1985 | Melzi et al. | 222/541 X |

*Primary Examiner*—H. Grant Skaggs
*Assistant Examiner*—Gregory L. Huson
*Attorney, Agent, or Firm*—Charles F. Pigott, Jr.

[57] ABSTRACT

A molded plastic container comprises an outer container having a first end wall portion. A tubular member extends from end to end through the interior of the container. The end wall portion defines a first annular area of weakness, the tubular member communicating with the end wall adjacent the first annular area of weakness. The user may apply longitudinal pressure on the end of the tubular member opposite to the end wall to rupture the first annular area and to permit the tubular member to slidingly advance out of the container interior through the ruptured area of the end wall, to serve as a pouring spout.

4 Claims, 3 Drawing Figures

MOLDED PLASTIC CONTAINER WITH INNER TUBULAR MEMBER

BACKGROUND OF THE INVENTION

In Von Holdt U.S. Pat. No. 4,452,382, a container closure is disclosed which is a snap-on lid defining an integrally attached spout. A removable tear tab may be torn away from the inside of the spout to open the container. The snap-on lid may be molded out of plastic and then snapped into sealing position, closing a plastic container so that the only access to it is by removal of the tear tab.

In accordance with this invention a container is provided, typically an oil container, in which an improved spout is provided. The container of this invention is as easily stored as conventional oil cans, but at the same time an integral spout is provided with each container, permitting easy delivery of the oil to an engine or the like.

In the prior art, an oil can may have an attached spout, but in that circumstance it is stored only with greater inconvenience than a conventional oil can, since the spout takes up added space. As the other prior art alternative, a reusable spout which punctures into the can must be used.

DESCRIPTION OF THE INVENTION

By this invention, a molded plastic container comprises an outer container having a first end wall portion. A tubular member extends from end to end through the interior of the container. The end wall portion defines a first annular area of weakness, the tubular member communicating with the end wall adjacent the first annular area of weakness.

As the result of this, one may manually apply sufficient longitudinal pressure on the end of the tubular member opposite to the end wall (by pressing or striking the opposite end of the container) to rupture the first annular area. This permits the tubular member to be slidingly advanced out of the container interior through the ruptured area of the end wall, to serve as a pouring spout.

Thus the container of this invention is the first container to include its own pouring spout which is stored substantially completely inside of the container, so that the container may be stacked and stored in the easy manner of a conventional oil can, or the like.

The first annular area of weakness is typically positioned immediately outside of the area of communication of the tubular member and the end wall. The outer container and the tubular member may be made of a single, integrally molded piece of plastic, with the first annular area of weakness being a thin portion of plastic just outside of the tubular member, which may be defined in the integral structure to project slightly through the end wall.

A second annular area of weakness may be positioned inside of the area of communication of the tubular member and the first end wall, with the tubular member and end wall being an integral piece as previously described. Means such as a tear tab for manually rupturing the second annular area are provided, so that one may pull the tear tab to open a flow passage through the bore of the tubular member. This second annular area of weakness may be another thin area in the molded end wall, initially integrally attached within the bore of the tubular member.

It is, of course, usually necessary to provide a seal between the sliding tubular member and the end wall after it has been extended out of the container to serve as a spout. To this end, the tubular member may define an annular, outwardly facing slot adjacent its opposite end which was initially remote from the end wall. This slot is proportioned to engage in sealing, snap-fit relation with the first end wall at the first annular area, after rupturing thereof has taken place. The bottom or radially innermost portion of the annular slot is of typically at least as large in diameter as the outer diameter of the tubular member in its area initially positioned adjacent the first end wall. Preferably, the annular slot is of slightly larger diameter, for example about 0.1 inch larger. Thus the portions of the end wall which define the aperture created by tearing away the first annular area of weakness can enter into sealing, snap-fit relation with this outwardly-facing slot, so that oil or other contents of the container may pour through the tubular member, which can act as a spout, without leakage.

The container may further define a second end wall opposed to the first end wall, which is preferably a molded piece carried on the container in sealing, snap-fit relation thereto. As an advantage of this, the container may be filled on automated filling machinery in inverted form, displaying a wide mouth to the filling machinery. Then the second end wall may be applied, and the container is thus sealed.

DESCRIPTION OF SPECIFIC EMBODIMENT

Figure 1:
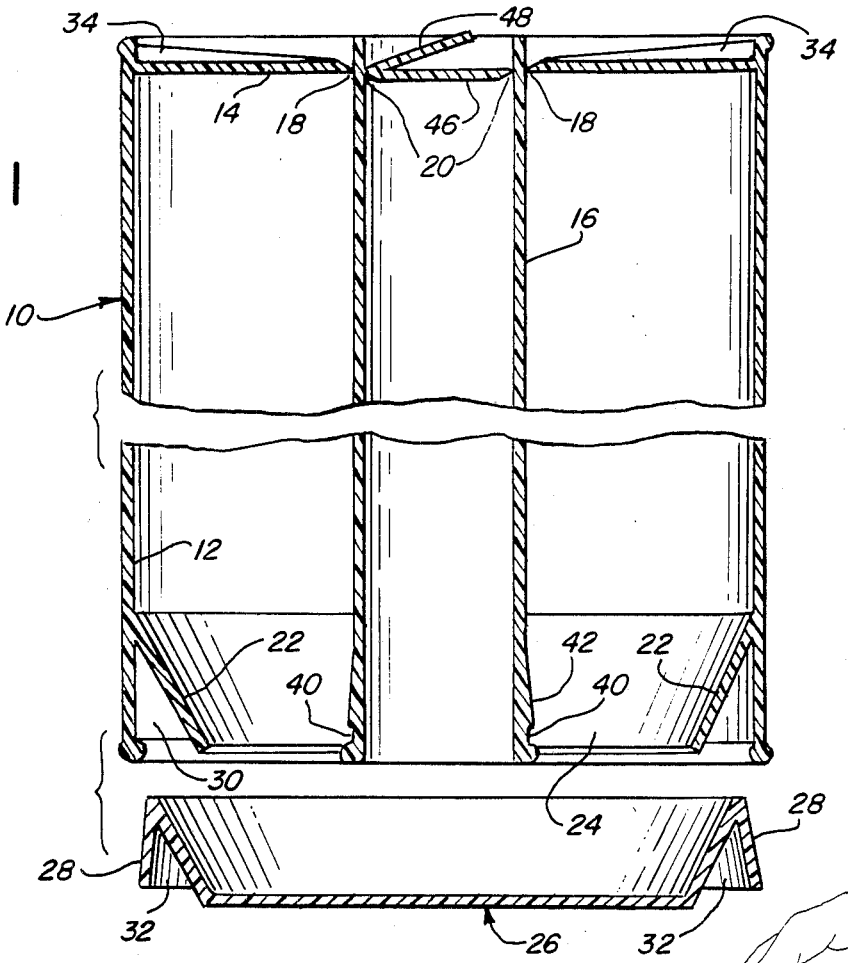
FIG. 1 is a transverse sectional view of a container in accordance with this invention, prior to application of the second end wall.
Figure 2:
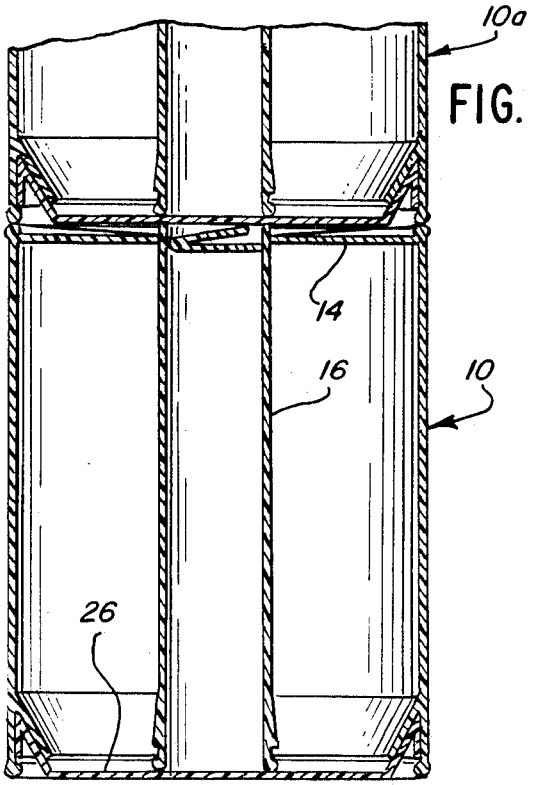
FIG. 2 is a longitudinal sectional view of the container of FIG. 1, shown in completed form and in stacked relation with a similar container.

Referring to FIGS. 1 and 2, container 10 of this invention discloses outer container 12 which may be an injection molded plastic can or other container of circular, oval, rectangular, or any other desired cross section. Outer container 12 may be molded as an integral piece with first end wall portion 14 and tubular portion 16, which may also be of typically circular, oval, or rectangular cross section, or the like. A first, thin annular area of weakness 18 and a second, thin annular area of weakness 20 may be provided inside and outside of tubular member 16 by a known two-stage clamp or coin molding process, with annular projections of the mold projecting into the mold cavity to provide thin sections of about 0.006 to 0.012 inch thickness in annular areas 18, 20, while the wall thickness of the rest of outer container 12 and tubular member 16 is substantially thicker.

Annular projecting flange 22 is also provided by the molding process at the bottom end of container 10 which is initially molded in open condition, to permit withdrawal of the mold core.

Accordingly, container 10 is easily filled by inverting it, and then inserting the desired contents through open end 24. Following this, second end wall 26, defining V-shaped annular projection 28 at its periphery, may be inserted into the annular slot 30 defined by flange 22 to form a permanent end closure for the container in accordance with Von Holdt U.S. Pat. No. 4,452,382. If desired, other designs of second end wall closures may be used. Particularly, annular slot 32 may contain reinforcing ribs if desired.

Also, reinforcing ribs 34 may be provided, if desired, on first end wall portion 14.

Container 10 may be stacked with other containers such as container 10*a* as shown in FIG. 2.

Tubular member 16, at its end opposite to first end wall 14, may define annular, outwardly facing slot 40, which is positioned in a radially outwardly flared portion 42 of tubular member 16. As the result of this, the bottom or radially innermost portion of annular slot 40 is typically of at least as large a diameter, and preferably a slightly larger diameter, than the outer diameter of tubular member 16 in its area initially positioned adjacent first end wall 14.

Central portion 46 of first end wall 14 may be isolated from the remainder of end wall 14 by tubular member 16. Tab 48 is provided for manual grasping, for removal of central portion 46 at the desired time.

Figure 3:
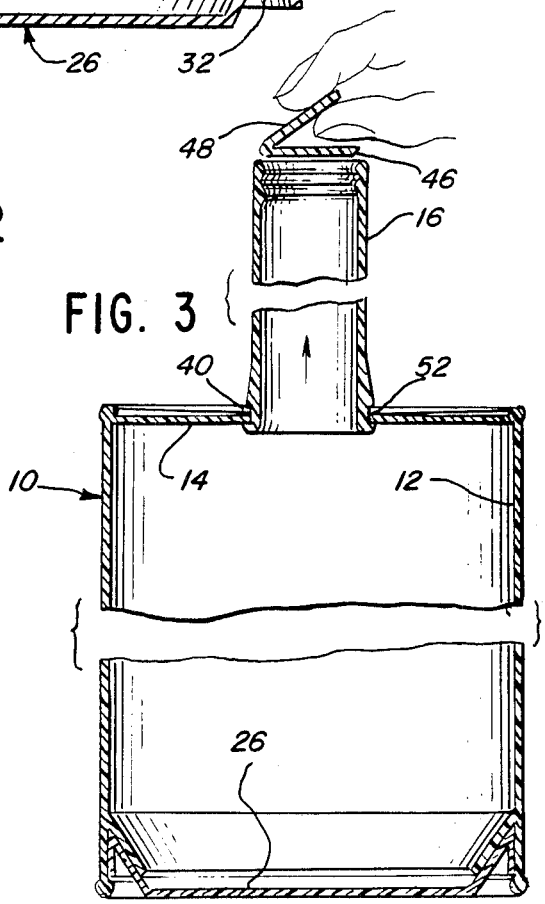
FIG. 3 is a longitudinal sectional view of the container of this invention, showing how the tubular member has been advanced to rupture the first annular area of weakness, and then further advanced into snap-fit relation with the first end wall portion, with the seal being removed by rupturing of the second annular area of weakness.

Accordingly, when one wishes to open the closed container 10, one presses or strikes firmly against second end wall 26 (which is somewhat flexible, being made out of molded plastic) to press tubular member 16 upwardly against first end wall 14. This causes first annular area of weakness 18 to rupture. One may then grasp tear tab 48, to slidingly pull tubular member upwardly out of container 10 to the position shown at FIG. 3. At this point the annular edge 52 of first end wall 14, which remains from the rupturing of first line of weakness 18, enters into snap-fit, sealing relation with outwardly facing groove 40. At this point, tubular member 16 is retained in its outwardly extended position. Further pulling of tab 48 causes the rupturing of second annular line of weakness 20, and the consequent removal of central portion 46.

Container 10 is now ready for dispensing of its contents, being equipped with an attached spout in the form of tubular member 16, which may be of the same length as container 10 for convenient application of oil or the like into an engine crankcase or other application.

The above has been offered for illustrative purposes only, and is not intended to limit the scope of the invention of this application, which is as defined in the claims below.

That which is claimed is:

1. A molded plastic container with comprises an outer container portion having a first end wall portion, a tubular member extending essentially completely from end to end through the interior of said container, a first end of said tubular member extending through said first end wall portion, a second end wall at the container end opposed to said first end wall portion, said first end wall portion defining a first annular area of weakness positioned immediately outside of the tubular member and a second annular area of weakness positioned immediately inside of the tubular member, said tubular member and first end wall portion being an integral piece, and means for manually rupturing said second annular area of weakness to open a flow passage through said first end of said tubular member, said tubular member also defining an annular, outwardly facing slot adjacent a second end of the tubular member to engage in sealing, snap-fit relation with the first end wall portion at said first annular area after rupturing thereof has taken place, a bottom of said annular slot being of at least as large diameter as an outer diameter of the tubular member's said first end at said first annular area of weakness, whereby one may press the second end of said tubular member by pressing said second wall portion to rupture said first annular area of weakness, and one may then pull said first end of said tubular member to advance said annular slot towards said first end wall portion until said annular slot enters into snap-fit, sealing relationship with said first end wall at the ruptured area, and then one may manually rupture said second annular area to open said flow passage.

2. The molded plastic container of claim 1 in which said tubular member is integrally molded with said outer container portion and first end wall portion.

3. The container of claim 1, in which said second end wall is carried on said container in sealing, snap-fit relation therto.

4. The molded plastic container of claim 3 in which said tubular member is integrally molded with said outer container portion and first end wall portion.

* * * * *